US005950445A

United States Patent [19]

Wang

[11] Patent Number: 5,950,445

[45] Date of Patent: Sep. 14, 1999

[54] COMPOUND CONDENSING DEVICE

[76] Inventor: Huai-Wei Wang, No. 10, Lane 145, Chung-Mei Road, Section 2, Chungli City, Taoyuan Hsien, Taiwan

[21] Appl. No.: 09/090,273

[22] Filed: Jun. 3, 1998

[51] Int. Cl.[6] ..... F25D 23/12

[52] U.S. Cl. ..... 62/259.4; 62/305; 62/316; 62/507; 165/117

[58] Field of Search ..... 62/259.4, 506, 62/507, 305, 316; 165/117; 261/154

[56] References Cited

U.S. PATENT DOCUMENTS

| | | | |
|---|---|---|---|
| 1,425,739 | 8/1922 | Adams | 62/305 |
| 2,181,354 | 11/1939 | Winters | 62/305 X |
| 3,658,581 | 4/1972 | Paul et al. | 427/379 |
| 3,984,995 | 10/1976 | Starr et al. | 62/305 |
| 4,440,216 | 4/1984 | Conti | 165/117 |
| 4,672,817 | 6/1987 | Croce | 62/506 X |
| 4,974,422 | 12/1990 | Kocher | 62/305 |

*Primary Examiner*—Henry Bennett
*Assistant Examiner*—Marc Norman
*Attorney, Agent, or Firm*—Dougherty & Troxell

[57] ABSTRACT

A compound condensing device to be used in an air conditioner having at least two condensing stages, one behind another, along the blowing direction of a common air blower to reduce the temperature and pressure of the refrigerant in the coiled pipe extending from the exiting end of the compressor and input end of the expanding device. In both condensing stages, coiled pipe sections are arranged in an up-and-down array, and evaporative cooling liquid droplets are distributed over the coiled pipe to extract heat from the refrigerant in the coiled pipe. Furthermore, fins and water-retaining material wrapping around the coiled pipe are used to increase the efficiency of evaporation. With the arrangement of two or more condensing stages, the exiting air from the compound condensing device has a temperature of about 28.5° C.

11 Claims, 4 Drawing Sheets

COMPOUND CONDENSING DEVICE

FIELD OF THE INVENTION

The present invention is related to a device for lowering the temperature and pressure of the refrigerant in the coiled pipe in an air conditioner.

BACKGROUND OF THE INVENTION

One of the major considerations for an air conditioner is its energy efficiency ratio (E.E.R.) in lowering the temperature and pressure of the refrigerant in the coiled pipe between the compressor and the expansion device. The temperature and pressure reduction can be achieved by a number of methods: air-cooling, dripping, evaporation, and water-cooling. The air-cooling method is generally achieved by the air flow through the fins installed around the coiled pipe and its total efficiency is about 2.2. Dripping and evaporation methods are generally provided by sprinkling an evaporative cooling liquid on the coiled pipe and the efficiency is about 3.5. The above-mentioned three methods are used in conjunction with an air blower for the circulation and exhaustion of air around the coiled pipe. The water-cooling method is provided by passing water through the heat exchanger and its efficiency is about 3.6.

Because there is a relationship between the reduction in temperature, pressure and the load and the noise generated by the expansion device and compressor, it is imperative to provide a device which can reduce energy consumption while prolong the life of the device itself

SUMMARY OF THE INVENTION

It is an objective of the present invention to provide a device which can efficiently absorb heat in the heat exchanger.

It is another objective of the present invention to provide a structure of heat exchanger which can efficiently use evaporation as a means for heat exchange.

It is a further objective of the present invention to provide a device for efficiently distributing small liquid droplets over the heat exchanger.

It is yet another objective of the present invention to provide a condenser which causes the evaporative cooling liquid to effectively in contact with the coiled pipes as droplets of the cooling liquid are sprayed on the coiled pipe.

In order to achieve the above-identified objectives, the compound condensing device, according to the present invention, comprises at least two condensing stages, one behind another, being placed along the blowing direction of a common air blower to reduce the temperature and pressure of the refrigerant in the coiled pipe extending from the exiting end of the compressor to the input end of the expanding device. In both condensing stages, coiled pipe sections are arranged in multiple array, and evaporative cooling liquid droplets are distributed over the coiled pipe to extract heat from the refrigerant in the coiled pipe. Furthermore, fins and water-retaining material wrapping around the coiled pipe are used to increase the efficiency of evaporation. With the water-retaining material, evaporative cooling liquid can stay with material and are constantly in contact with the outer wall of the coiled pipe. When the water-retaining layer is saturated with the cooling liquid, the excessive liquid on the upper coiled pipe sections is caused to reach the lower coiled pipe sections by a net-like structure of narrow strips of a certain material connecting the coiled pipe sections. The water-retaining material also effectively increases the surface area for evaporation. Based on the same principle, the outer wall of the coiled pipe can also be made into a rough surface to increase the evaporation efficiency.

With the arrangement of two or more condensing stages, the exiting air from the compound condensing device, according to the present invention, is not a heated exhaust gas as that exiting from a conventional condenser. Instead, the exiting air from the compound condensing device has a temperature of about 28.5° C.

It should be that the condensing stage which uses water-retaining layer for evaporation is itself an efficient heat-exchange unit. Thus, one or more of this condensing stages can be used in an air conditioner without being coupled to the condensing stage that uses fins for evaporation. The present invention is further described with reference to the embodiment shown in the drawing figures.

DETAILED DESCRIPTION OF THE PREFERRED EMBODIMENTS

Figure 1:
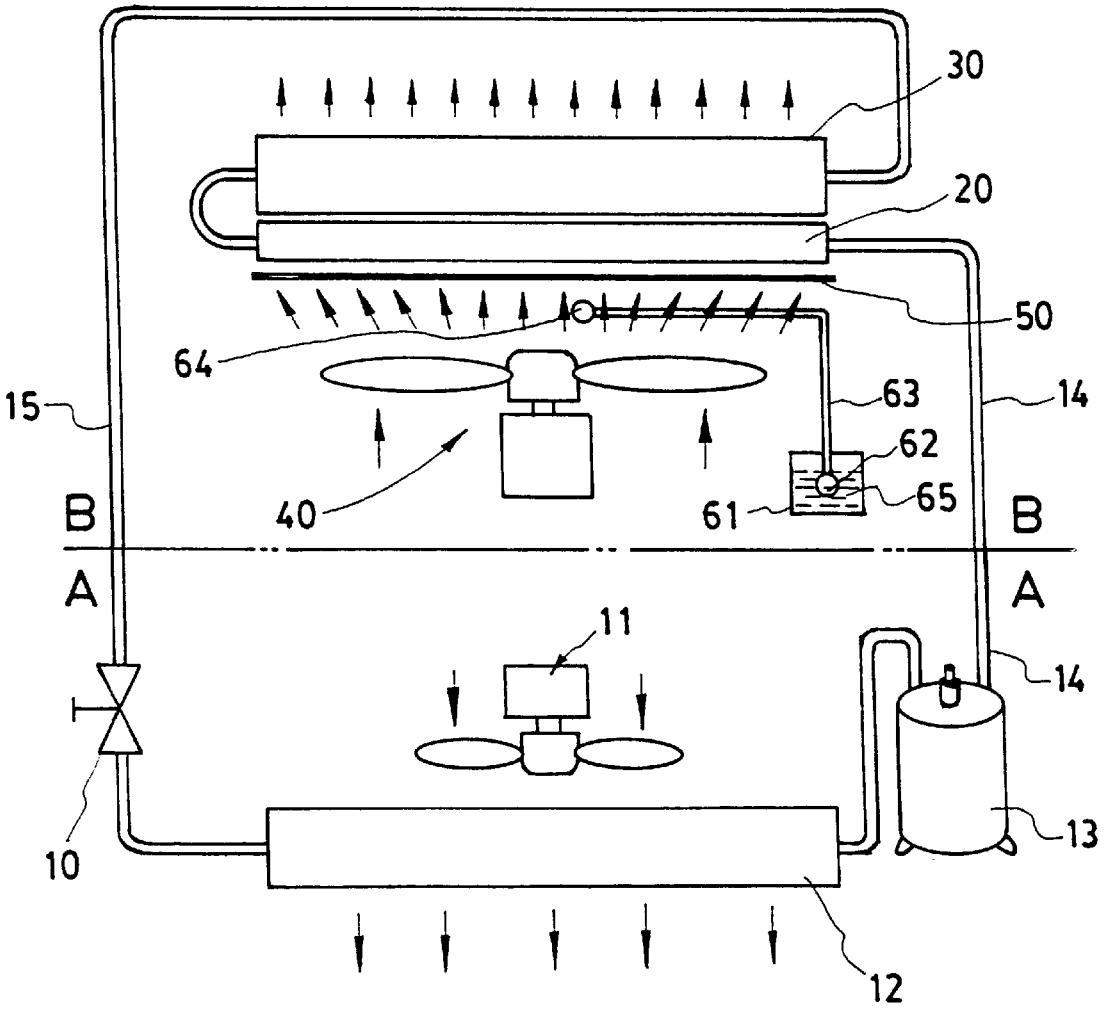
FIG. 1 is a schematic view of the operation of the air conditioner, according to the present invention.

A schematic view for the operation of the air conditioner of the present invention is shown in FIG. 1. As shown in FIG. 1, the air conditioner is divided into an indoor section A and an outdoor section B. As shown in section A, after the refrigerant is expanded into an evaporator 12 by the expansion device 10, it's pressure and temperature are lowered. A fan 11 is used to force an air flow through the evaporator 12 to provide cooled air for the indoor. After passing through the evaporator 12, the refrigerant is recompressed into high pressure gas by means of a compressor 13. The compressed gas is lead into the outdoor section B through a pipe 14 and the refrigerant is lead back to the expansion device 10 through a pipe 15.

Figure 2:
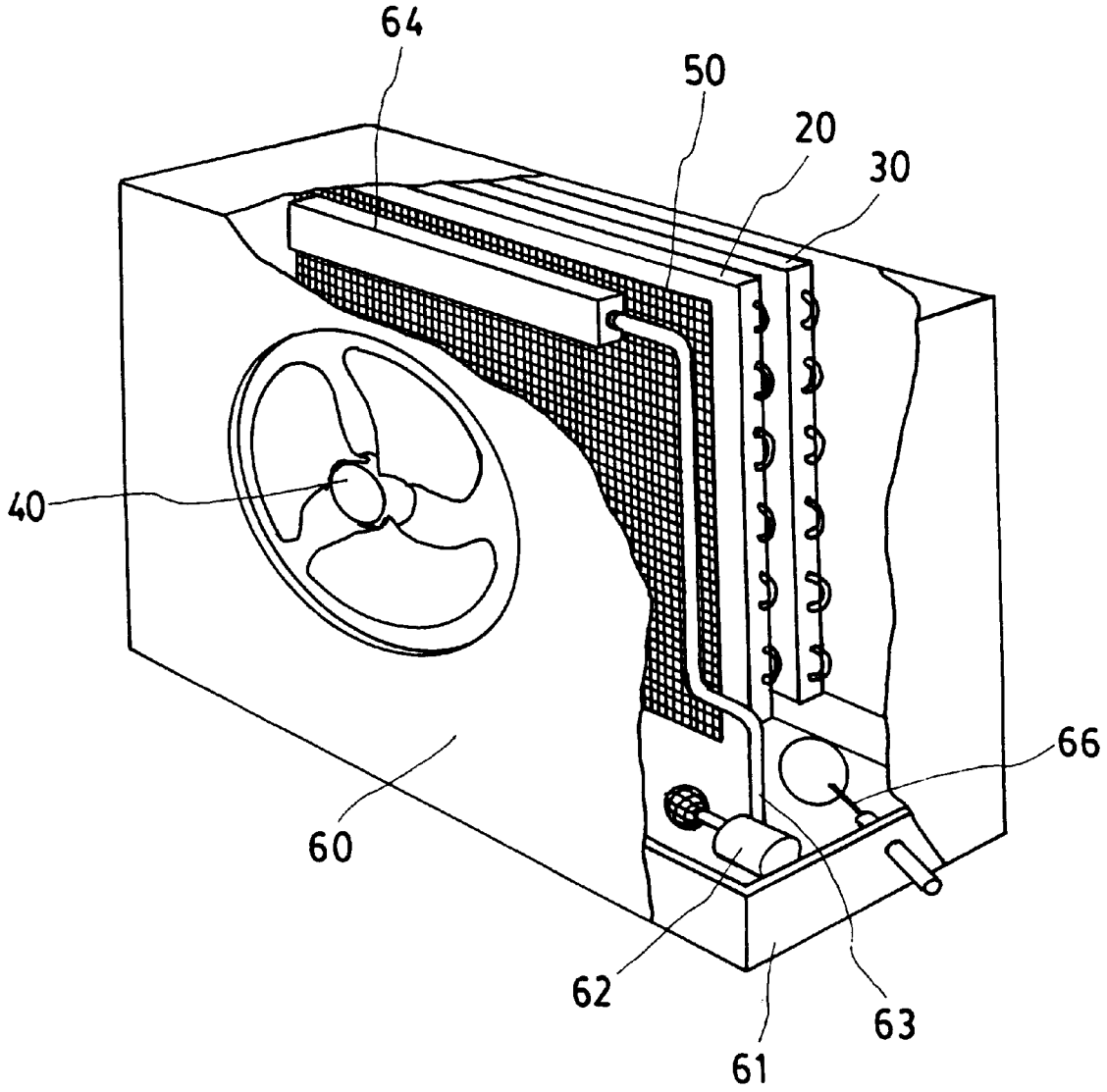
FIG. 2 is a perspective view of the condensing device, showing a partial cutout section.

As shown in FIG. 1 and FIG. 2, the outdoor section B includes a first condensing stage 20 and a second condensing stage 30, enclosed by a casing 60. A liquid container 61 is used to store a certain amount of evaporative cooling liquid 65. The evaporative cooling liquid, which can also be water, is fed through a pipe 63 by feeding means 62 to a liquid dispenser 64. An air blower 40 is provided to transfer the liquid dispensed from the liquid dispenser 64 onto a liquid droplet distributor 50 which produces a mist or a spray of droplets along the wind direction. These evaporative liquid droplets are sprayed on the first and then the second condensing stage. Preferably, a liquid-level sensing switch 66 is provided in the proximity of the liquid container 61 to ensure proper amount of evaporative cooling liquid is in the container. The liquid dispensed from the liquid feeding means can also be allowed to drip onto the condensing stages.

Figure 3:
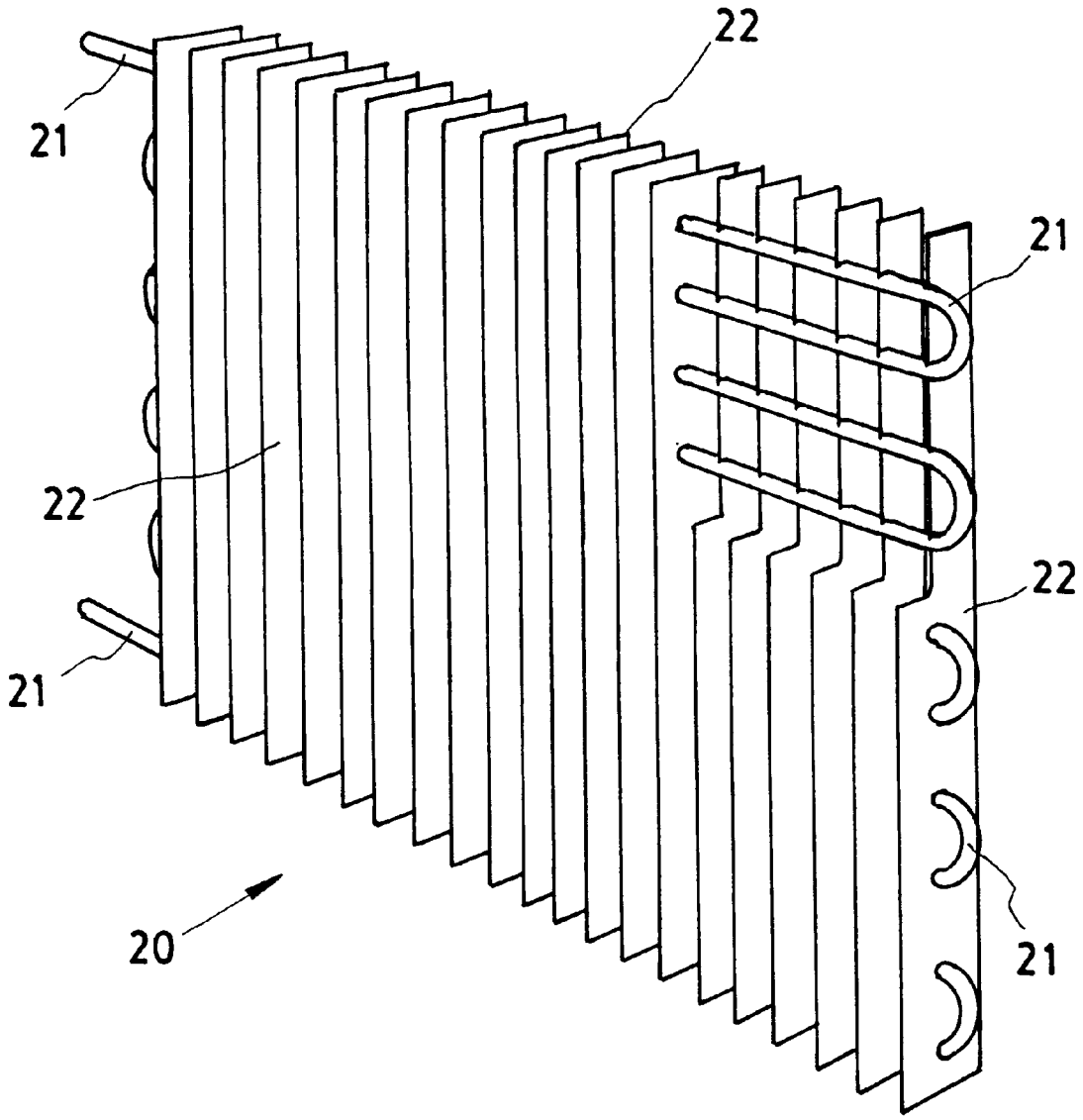
FIG. 3 is a perspective view of the first condensing stage, showing a partial cutout section.

The schematic view of the first condensing stage is shown in FIG. 3. As shown, the first condensing stage 20 consists of a plurality of coiled pipe sections 21 arranged in an up-and-down array, one section over another. A plurality of fins 22 are installed over the external wall of the coiled pipe to conduct heat away therefrom. Sufficient spacing is provided between two adjacent fins and between two coiled pipe sections to allow air and water droplets to pass through easily. The end of the coiled pipe 21 of the first condensing stage is guided to the second condensing stage 30 to become the coiled pipe 31 as shown in FIG. 4.

The second condensing stage is arranged behind the first condensing stage along the wind direction of the blower 40 in such a fashion that one common blower can effectively cause evaporation in more than one condensing stage. In fact, when necessary, it is plausibly to have more than two condensing stages arranged in tandem to share the air-flow from a common blower.

Figure 4:
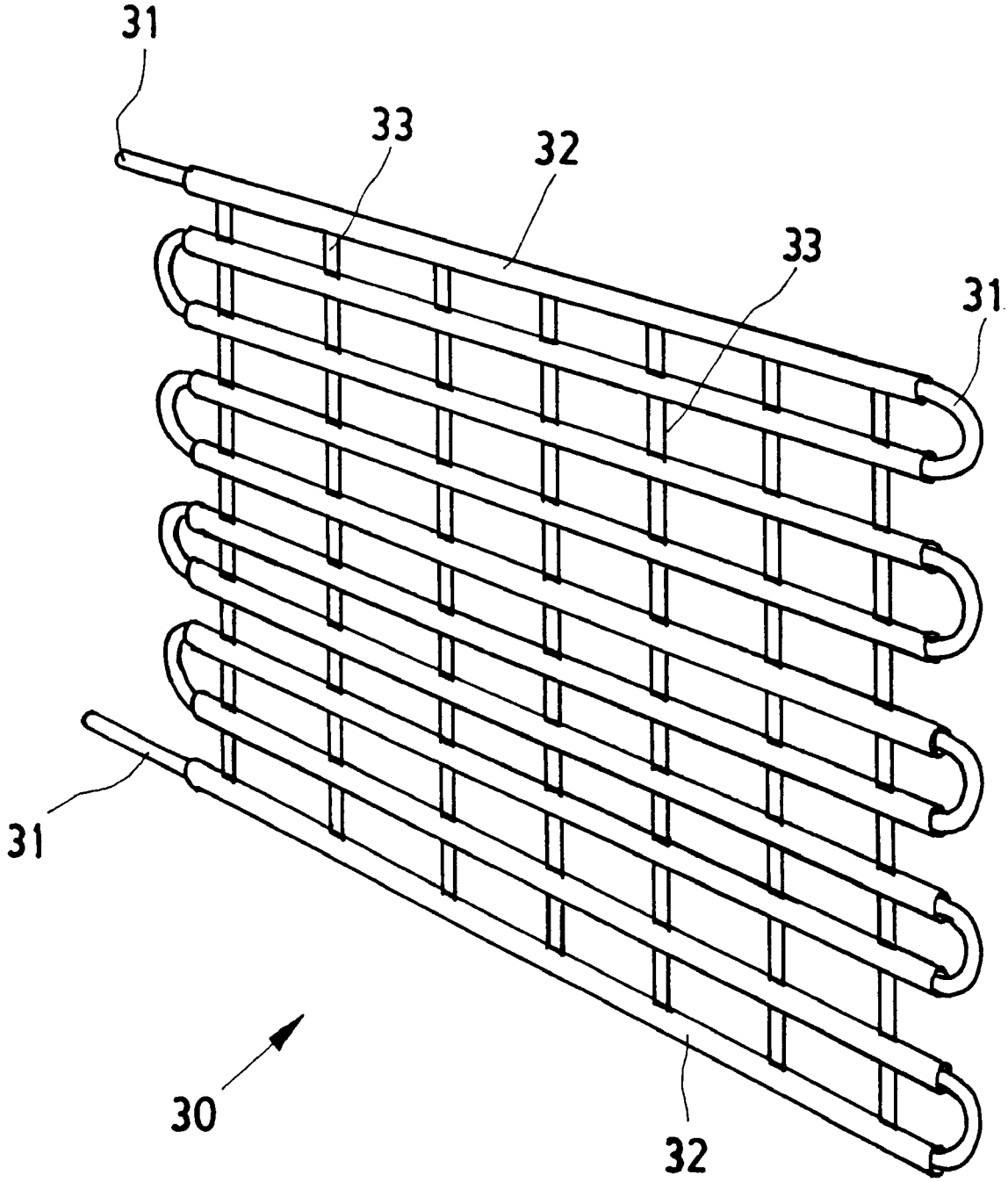
FIG. 4 is a perspective view of the second condensing stage of the present invention.

The schematic view of the second condensing stage is shown in FIG. 4. As shown, a plurality of coiled pipe sections 31 are arranged in an up-and-down array, one section over another. On each coiled pipe section 31, a water-retaining material 32 is used to wrap around the outside wall of the coiled pipe. The purpose of having this water-retaining layer is to allow a certain amount of evaporative cooling liquid to be constantly in contact with the outside wall to extract the heat from the coiled pipe and the refrigerant inside the coiled pipe. The water-retaining material can be a woven or non-woven type fabric, or of other suitable materials. A net-like structure of strips 33 connecting different coiled pipe sections 31 is used to guide excessive cooling liquid in the water-retaining layer 32 on the upper coiled pipe sections to reach the lower sections. With these strips, heated cooling liquid in the water-retaining layers can be replaced by a fresh supply of cooling liquid. It should be noted that the net-like structure of strips 33 can be substituted by another structure which can serve the same purposes. Furthermore, if the evaporative cooling liquid can be efficiently distributed over the water-retaining layers, then the strips 33 may not be required. The end of the coiled pipe 31 will be lead to the expansion device 10 as shown in FIG. 1.

In FIG. 1, the expansion device is installed within the indoor section A. But it can also be installed within the outdoor section B, inside or outside the casing 60 shown in FIG. 2.

The flowing direction of the refrigerant is from the compressor 13, as shown in FIG. 1, through the pipe 14 to the coiled pipe 21 in the first condensing stage 20, the coiled pipe 31 of the second condensing stage 30 and finally to the expansion device 10 through the pipe 15. It is understood that the coiled pipes 21, 31 and the pipes 14, 15 can be made out of the same pipe. Furthermore, the coiled pipe sections in the first and second condensing stages can be arranged differently. For example, the coiled pipe sections can be arranged in an upright fashion. Also, the position of the first condensing stage 20 and second condensing stage 30, relative to the blower 40, can be reversed. And coiled pipe sections in the two condensing stages can be stacked, one stage above another, and more than two condensing stages are also plausible. Moreover, the external wall of the coiled pipe can have a certain finish, such as a rough surface finish, to better retain the cooling liquid for more effective evaporation.

It should be noted that the inclusion of a first condensing stage 20 in an air conditioner as shown in FIG. 1 and FIG. 2 is to assure that even when the evaporative cooling liquid is depleted in the air conditioner, rendering the second condensing stage 30 ineffective, the air conditioner is still operable due to the fins installed in the first condensing stage. However, when the supply of the evaporative cooling liquid is adequate at all times, it is plausible to install in an air conditioner with one or more second condensing stages without having the first condensing stage.

The present invention has been disclosed in preferred forms and the drawing figures are for illustrative purposes only. It shall be understood by those skilled in the art that many modifications, additions and deletions can be made therein without departing from the scope of the invention as set forth in the appended claims.

What is claimed is:

1. A compound condenser to be used in an air conditioner comprising a compressor, an expansion device, an evaporator and a fan associated with the evaporator to blow cooled air from the air conditioner, a network of pipelines to provide conduit for refrigerant in the air conditioner, and means for dispensing evaporative cooling liquid; characterized in that the compound condenser comprises a first condensing stage and a second condensing stage for reduceing the temperature of the refrigerant in the pipeline flowing from said compressor to said expansion device, and an air blower associated with the first and second condensing stages to aid evaporation of the evaporative cooling liquid dispensed from said dispensing means, wherein the first condensing stage comprises a first array of coiled pipe sections having thereon a plurality of fins for receiving evaporative cooling liquid from said dispensing means to reduce the temperature of the refrigerant in the first array of coiled pipe sections; and the second condensing stage comprises a second array of coiled pipe sections having thereon water-retaining material to receive evaporative cooling liquid from said dispensing means to reduce the temperature and pressure of the refrigerant in the second array of coiled pipe sections.

2. The compound condenser of claim 1 wherein said dispensing means provide droplets of evaporative cooling liquid to the first condensing stage.

3. The compound condenser of claim 1 wherein said dispensing means provides droplets of evaporative cooling liquid to the second condensing stage.

4. The compound condenser of claim 1 wherein said dispensing means provides droplets of evaporative cooling liquid to the first and second condensing stages.

5. The compound condenser of claim 1 wherein the surface of the first array of coiled pipe sections have a rough surface finish.

6. The compound condenser of claim 1 wherein the surface of the second array of coiled pipe sections have a rough surface finish.

7. The compound condenser of claim 1 further comprising at least one additional first condensing stage.

8. The compound condenser of claim 1 further comprising at least one additional second condensing stage.

9. The compound condenser of claim 1 wherein the first condensing stage further comprises a plurality of strips connecting the water-retaining material on the second array of coiled pipe sections to aid distributing evaporative cooling liquid onto said water-retaining material.

10. The evaporative liquid coolant dispensing means of claim 1 comprising a liquid droplet distributor.

11. The evaporative cooling liquid dispensing means of claim 10 comprising a liquid container to hold the evaporative cooling liquid and means for feeding the evaporative cooling liquid to said liquid droplet distributor.

* * * * *